US009033113B2

(12) United States Patent
Winey

(10) Patent No.: US 9,033,113 B2
(45) Date of Patent: May 19, 2015

(54) BUILDING SWAY RESISTANT ELEVATOR DERAILMENT DETECTION SYSTEM

(75) Inventor: Phillip A. Winey, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 772 days.

(21) Appl. No.: 13/379,406

(22) PCT Filed: Jul. 20, 2009

(86) PCT No.: PCT/US2009/051153

§ 371 (c)(1),
(2), (4) Date: Dec. 20, 2011

(87) PCT Pub. No.: WO2011/010991

PCT Pub. Date: Jan. 27, 2011

(65) Prior Publication Data

US 2012/0097487 A1 Apr. 26, 2012

(51) Int. Cl.
*B66B 1/34* (2006.01)
*B66B 5/02* (2006.01)

(52) U.S. Cl.
CPC ..... *B66B 5/021* (2013.01); *B66B 5/022* (2013.01)

(58) Field of Classification Search
CPC ..... B66B 5/021; B66B 5/022
USPC ..... 187/247, 278, 293, 391–393
See application file for complete search history.

(56) References Cited

U.S. PATENT DOCUMENTS 3,791,490 A * 2/1974 Smith ..... 187/278
4,056,169 A 11/1977 Showalter
4,072,213 A 2/1978 Salmon
4,096,925 A 6/1978 Koob et al.

(Continued)

FOREIGN PATENT DOCUMENTS

EP 0 577 781 B1 5/1997
JP 56-3266 1/1981

(Continued)

OTHER PUBLICATIONS

Translation JP 2003-321169.*

(Continued)

*Primary Examiner* — Anthony Salata
(74) *Attorney, Agent, or Firm* — Miller, Matthias & Hull LLP

(57) ABSTRACT

An elevator derailment detection system (51) which provides for accurate detection of the derailment of a movable element (30, 32), such as a counterweight (32) or an elevator car (30), within a hoistway (22) even when the building (24) within which the elevator (20) is installed is of a substantial height and may be experiencing a significant degree of sway due to high winds, earthquakes, or other causes. By mounting an electric conductor (52) such as a sensing wire of the system (51) at spaced intervals (76) along the length of the hoistway (22), the electric conductor (52) in turn sways with the building (24). Accordingly, contact of the electrical conductor with sensors attached to a movable element within the hoistway, such as the counterweight, is limited to derailment situations and not normal building sway, and false trips are significantly reduced. In addition, by providing mounting brackets (60, 62, 64) and sensing apparatus (66) with a non-continuous perimeter, the operation and movement of the respective components (30, 32) is not hindered by this system (51).

22 Claims, 4 Drawing Sheets

(56) References Cited

U.S. PATENT DOCUMENTS

| | | | | |
|---|---|---|---|---|
| 4,106,594 | A | 8/1978 | Kirsch et al. | |
| 4,460,065 | A | 7/1984 | Saxer | |
| 4,643,276 | A * | 2/1987 | Philobos | 187/278 |
| 4,793,441 | A | 12/1988 | Cilderman et al. | |
| 5,036,954 | A | 8/1991 | Haahtikivi et al. | |
| 5,103,937 | A | 4/1992 | Robertson | |
| 5,861,084 | A | 1/1999 | Barker et al. | |
| 5,947,232 | A | 9/1999 | Traktovenko et al. | |
| 6,488,125 | B1 | 12/2002 | Otsuka et al. | |
| 6,578,673 | B2 | 6/2003 | Barker et al. | |
| 6,712,183 | B2 | 3/2004 | Otsuka et al. | |
| 7,387,192 | B2 | 6/2008 | Cloux et al. | |
| 2012/0024636 | A1 * | 2/2012 | Niikawa | 187/391 |
| 2013/0206515 | A1 * | 8/2013 | Quinn | 187/250 |
| 2014/0000985 | A1 * | 1/2014 | Fukui et al. | 187/247 |
| 2014/0069747 | A1 * | 3/2014 | Benosman | 187/414 |

FOREIGN PATENT DOCUMENTS

| | | | |
|---|---|---|---|
| JP | 63-42678 | | 3/1988 |
| JP | 2003-321169 | A | 11/2003 |
| JP | 200901604 | A | 3/2009 |
| KR | 1020010035900 | | 4/1999 |
| KR | 1020070014225 | | 10/2007 |
| WO | WO-92/17396 | | 10/1992 |
| WO | WO-2004/067430 | A1 | 8/2004 |
| WO | WO-2005/113403 | A1 | 12/2005 |
| WO | WO-2007/067491 | A1 | 6/2007 |

OTHER PUBLICATIONS

Office Action for related Chinese Application No. 200980160671.1; action dated Aug. 20, 2013.

International Search Report and Written Opinion from related International Application No. PCT/US2009/051153; report dated Jan. 21, 2010.

* cited by examiner

BUILDING SWAY RESISTANT ELEVATOR DERAILMENT DETECTION SYSTEM

CROSS-REFERENCE TO RELATED APPLICATIONS

This application is a U.S. national stage filing of International Patent Application No. PCT/US09/51153, filed on Jul. 20, 2009.

FIELD OF THE DISCLOSURE

The present disclosure generally relates to elevators and, more particularly, relates to systems for detecting the derailment of a movable element within an elevator.

BACKGROUND OF THE DISCLOSURE

In modern society, elevators have become ubiquitous machines for transporting people and cargo through buildings of multiple stories. Upon their advent, cities immediately had the option of building upwardly as opposed to only outwardly, thereby contributing to the modern high-rise city landscape and current urban planning models.

Today, the levels of the highest buildings in the world continue to grow, with buildings over one-hundred stories being commonplace; the limits for skyscrapers are being pushed to one hundred and fifty floors or more. That increased height creates multiple new challenges and magnifies existing ones for elevator designers. For example, in a building of such height, is not uncommon for the building at its apex to sway back and forth in excess of three feet or more. Accordingly, each of the mechanical components of the building, including the elevator, must be built to withstand such lateral motion. This is particularly true in areas prone to high winds or earthquakes, where building sway could be even more severe.

One challenge created by the sway of very high buildings has been to provide a mechanism by which the derailment of the elevator car, counterweight, or other moving component can be easily detected with minimal false readings. For years, such detection systems have primarily consisted of a so-called "ring and string" device wherein an electric conductor such as a wire string is extended vertically through the hoistway of the elevator and held at electrical potential. The string is typically mounted only at the top and bottom of the hoistway. A sensing ring is in turn physically mounted to a movable element in the hoistway, such as the counterweight. The sensing ring completely circumscribes the electrical conductor but in spaced relation thereto. When installed and properly aligned, as the counterweight moves up and down on the rail, the sensing ring does not come in contact with the electrical conductor, even with a moderate level of building sway. However, if the counterweight becomes derailed, the sensing ring will contact the electrical conductor. Because the conductor is held at potential, the contact between the ring and the conductor closes a circuit, directing current to flow from the conductor into the counterweight, which in turn is detected by the derailment detection system of the elevator.

As building heights have steadily increased, the sway component mentioned above tends to cause more false readings in the derailment detection system than is desired by the end-user. In particular, even when the counterweight or the movable element within the hoistway are properly mounted on the rails of the system, if the building encounters significant sway either due to high winds or otherwise, the rails on which the movable element is mounted will tend to sway with the building, and in turn cause the sensor itself to sway. However, the electrical conductor stays fixed within the hoistway, in which it is attached only at its top and bottom, so that when the rail and counterweight sway, the ring can potentially contact the wire or electrical conductor, resulting in improper activation of the elevator derailment detection system. This not only inconveniences the end-user in that the elevator will stop or otherwise become less than fully operational, but also results in added expense in terms of maintenance costs for the building.

SUMMARY OF THE DISCLOSURE

In accordance with one aspect of the disclosure, an elevator derailment detection system is therefore provided. The system may include a movable element slidably mounted on a rail, an electrical conductor extending through a hoistway and held at electrical potential, a plurality of mounting brackets connecting the electrical conductor to a fixed element within the hoistway, and a sensor connected to the movable element. The sensor may include a sensing head having a non-continuous perimeter partially surrounding and in spaced relation to the electrical conductor.

In accordance with another aspect of the disclosure, a method of reducing false trips on an elevator derailment detection system is disclosed comprising extending an electrical conductor through an elevator hoistway provided in a building, holding the conductor at electrical potential, connecting the electrical conductor within the hoistway such that the electrical conductor moves substantially in concert with the hoistway as the building sways, and mounting a sensor to a movable element slidably mounted within the hoistway. The sensor may include a sensing head at least partially surrounding, and in spaced relation to, the electrical conductor.

In accordance with another aspect of this disclosure, an elevator derailment detection system is disclosed comprising a hoistway, a rail extending within the hoistway, a counterweight slidably mounted on the rail, an electrical conductor extending vertically through the hoistway and held at electrical potential, a plurality of mounting brackets connecting the electrical conductor to the rail, and a sensor connected to the counterweight and including a sensing head having a non-continuous perimeter substantially surrounding, and in spaced relation to, the electrical conductor.

These and other aspects of the disclosure will become more apparent upon reading the following disclosure when taken in conjunction with the accompanying drawings.

Figure 1:
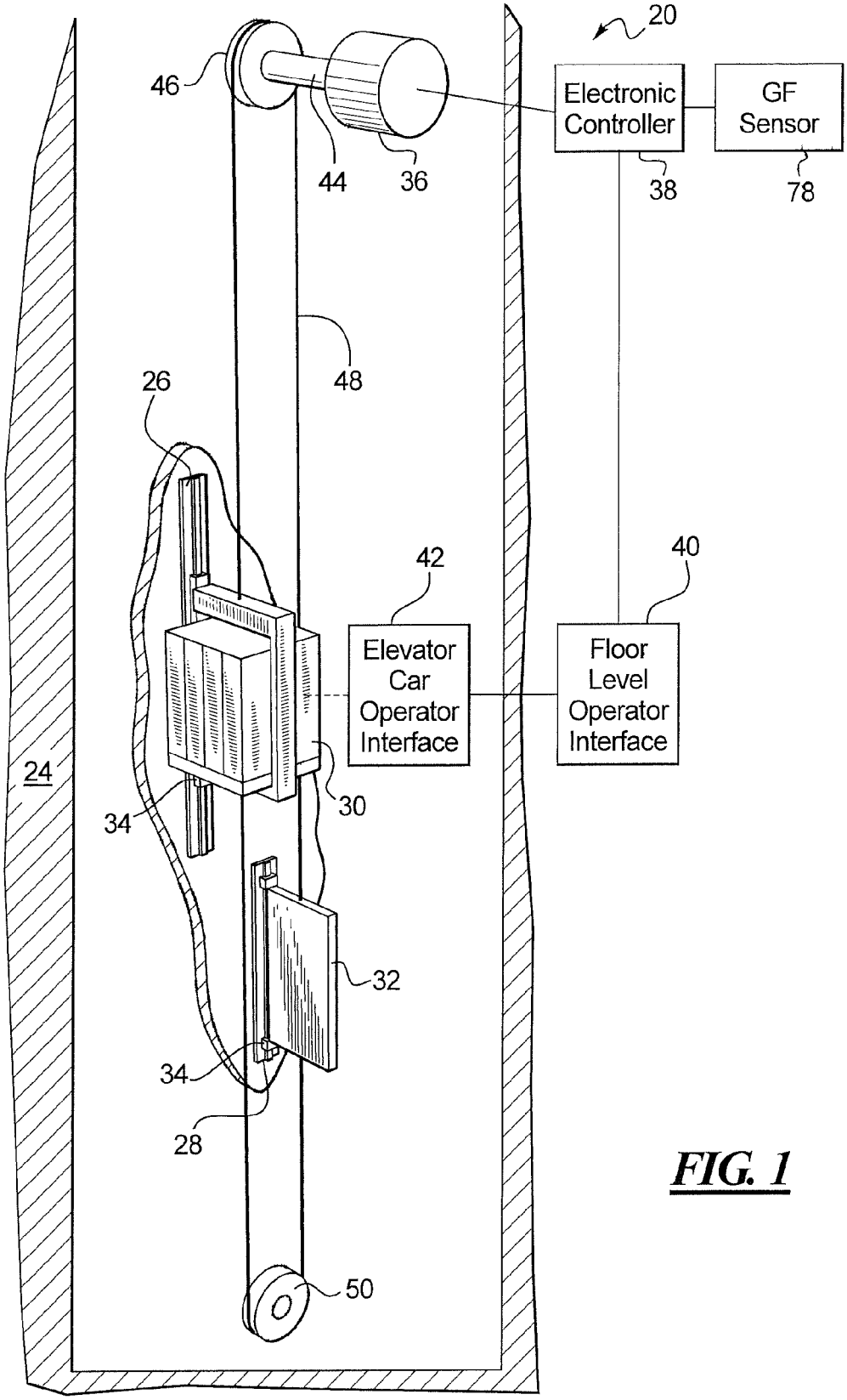
FIG. 1 is a schematic representation of a hoistway.

While the present disclosure is susceptible to various modifications and alternative obstructions, certain illustrative embodiments thereof have been shown in the drawings and will be described below in detail. It should be understood, however, that there is no intention to be limited to the specific forms disclosed, but on the contrary, the intention is to cover all modifications, alternative constructions, and equivalents falling within the spirit and scope of the present disclosure.

DETAILED DESCRIPTION OF THE DISCLOSURE

Referring now to FIG. 1, an elevator system 20 is shown in schematic fashion. It is to be understood that the version of the elevator 20 shown in FIG. 1 is for illustrative purposes only and to present background for the various components of a general elevator system. The specifics of the present disclosure are set forth in FIGS. 2-7 and the following specification.

As shown in FIG. 1, the elevator system 20 includes a hoistway 22 provided vertically within a multi-story building 24. Typically, the hoistway 22 would be a hollow shaft provided within a central portion of the building 24 with multiple hoistways being provided if the building is of sufficient size and includes multiple elevators. Extending substantially the length of the hoistway 22 are rails 26 and 28. An elevator car 30 may be slidably mounted on the rail 26 and a counterweight 32 may be slidably mounted on rail 28. While not depicted in detail in FIG. 1, one of ordinary skill in the art will understand that both the car 30 and counterweight 32 would include roller mounts 34, bearings, or the like for smooth motion along the rails 26 and 28. The roller mounts, bearings, or the like may also be slidably mounted to the rails 26 and 28 in a secure fashion so as to deter easy derailment of same.

In order to move the car 30 and thus the passengers and/or cargo loaded thereon, a motor 36 is provided typically at the top of hoistway 22. Connected to the motor 36 is an electronic control 38 which in turn is connected to a plurality of operator interfaces 40 provided on each floor to call the elevator car 30, as well as operator interfaces 42 provided on each car 30 to allow the passengers thereof to dictate the direction of the car 30. Mechanically extending from the motor 36 is drive shaft 44, which in turn is connected to a pulley or a sheave 46. Trained around the sheave 46 is a cable or a belt 48 which forms a continuous loop about lower sheave 50. The cable 48 is in turn connected to counterweight 32 and car 30. Of course, multiple different embodiments or arrangements of these components are possible with a typical system including multiple belts 48 as well as various arrangements for the motor and sheaves of the elevator system 20.

Figure 2:
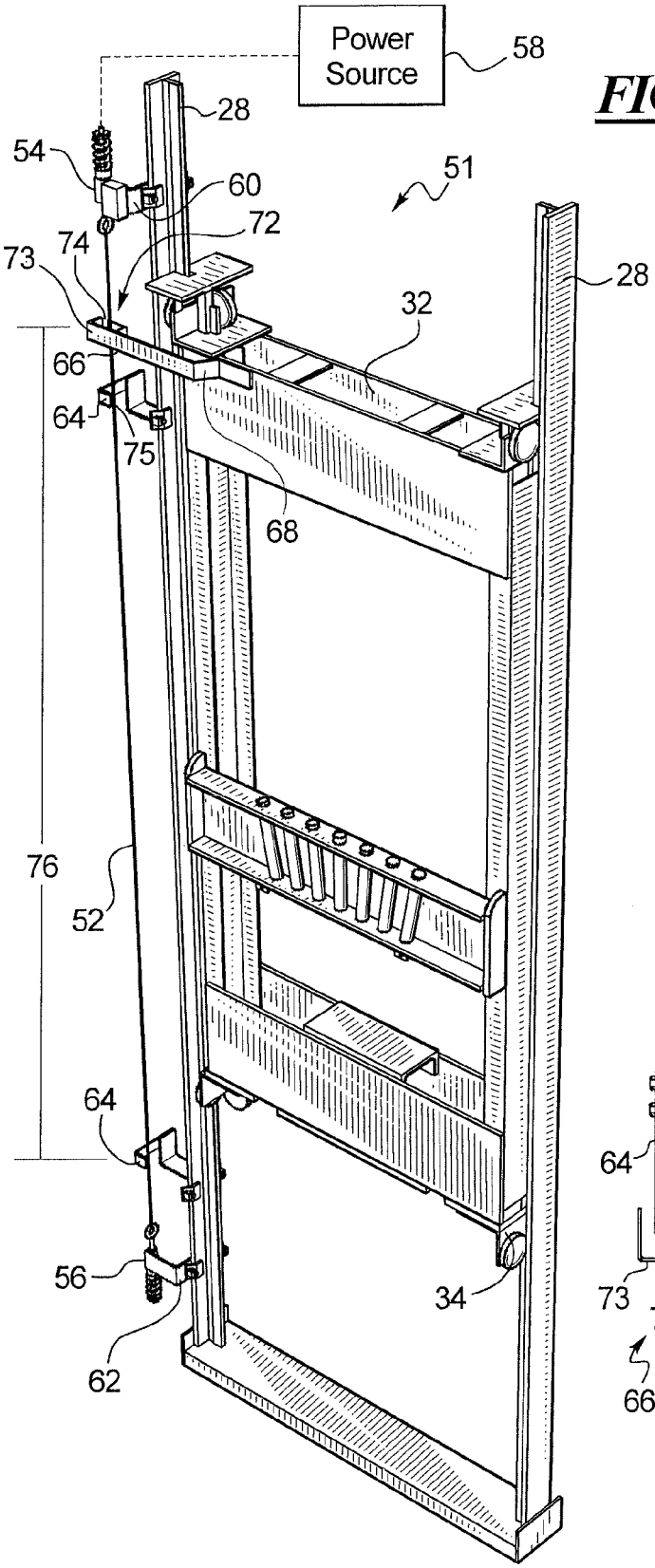
FIG. 2. is an isometric view of the first embodiment of the present disclosure mounted on a counterweight of an elevator.

Referring now to FIG. 2, a first embodiment of an elevator derailment detection system 51 according to the present disclosure is shown in more detail. As depicted, the first embodiment includes a counterweight 32 mounted on a rail 28. While not essential, the counterweight 32 would typically be mounted on two rails 28, as shown. Mounted in proximity to the rail 28 is an electric conductor or wire 52. The electric conductor 52 extends substantially the length of the hoistway 22 and is secured at a top 54 and a bottom 56 thereof. The electric conductor 52 is held at electric potential meaning that it is electrically charged and connected to a power source 58. The power source 58 need not be of significant voltage, with 21 volts being one non-limiting example. The electric conductor 52 is secured at top 54 and bottom 56 by mounting brackets 60 and 62, respectively, which also electrically isolate the electric conductor 52 from the rest of the elevator system 20. The mounting brackets 60 and 62 are mounted to fixed elements within the hoistway 22, such as the rails 28 themselves, concrete or metal surfaces within the hoistway 22, or the like.

In addition to the mounting brackets 60 and 62 at the top and bottom of the hoistway 22, a plurality of intermediary mounting brackets 64 are connected to fixed elements within the hoistway 22 as well. Similar to mounting brackets 60 and 62, intermediary mounting brackets 64 electrically isolate the electrical conductor 52 from the rest of the elevator system 20. This can be achieved by manufacturing the mounting brackets 60, 62, 64 from electrically insulative materials such as plastic or the like. By using the intermediary brackets 64 in combination with the top and bottom mounting brackets 60, 62, as the rails 28 sway, the electric conductor 52 sways substantially in concert with the rails 28, the importance of which will be described in further detail below.

Figure 3:
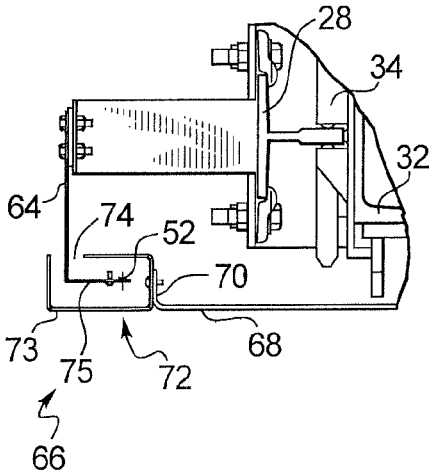
FIG. 3 is enlarged view of a section of FIG. 2 showing a sensor and mounting bracket in greater detail.

Referring to FIG. 3, the first embodiment is shown in greater detail to illustrate a sensor 66 extending from the movable element, which in this embodiment is the counterweight 32. The movable element could of course be the elevator car 30 or another similar movable device slidably mounted within the hoistway within the elevator system 20. The sensor 66 may include a base 68 secured to the movable element. Extending from a distal end 70 of the base 68 is a sensing head or detector 72. The sensing head 72 can be of many shapes and configurations as further described below, with that depicted in FIG. 3 having a substantially G-shaped configuration. The sensing head 72 and mounting base 68 are manufactured from metal or some other form of electrically conductive material, such that the sensing head 72 is potentially electrically connected to the counterweight or other movable element as herein described.

By providing the sensing head 72 in a G-shaped configuration or some other form having a non-continuous perimeter 73 with an opening 74, as the counterweight or other movable element moves up and down on its respective rail, the sensing head 72 can move past the intermediary mounting brackets 64 without contact. For example, in other embodiments, the sensing head 72 could be provided in a U-shape, C-shape, or in any other form having a non-continuous perimeter. In order to facilitate the respective motions of the sensing head 72 past the intermediary mounting brackets 64, the intermediary mounting brackets 64 could include a canted or L-shaped distal end 75.

It is also important to note that regardless of its shape, the sensing head 72 is normally held in spaced relation from the electric conductor 52. In other words, when the elevator system 20 is installed properly and aligned, and the building is not swaying and the movable element is not derailed, the sensing head 72 should not be in contact with the electrical conductor 52. Rather, the sensing head 72 should be spaced from and partially surrounding the electrical conductor 52, at a distance sufficient to avoid conduction of electricity from the electrical conductor 52 through the sensing head 72 and thus to the rest of the elevator system 20, causing a false trip or other indication of derailment.

Based on the foregoing, it can be seen that if the building 24 is subjected to a significant degree of sway, the rails 26 and 28 of the elevator system 20 will in turn sway with the building 24. In prior systems, the electric conductor of the derailment detection system, which typically would be fixed at only the top and bottom, would not sway with the rails 26, 28, and thus the electric conductor would actually contact the sensing head and thereby generate an alarm or safety trip within the system suggesting that the movable element had become derailed from its respective rail. This in turn would cause the elevator system 20 to shut down or otherwise be at less than peak efficiency until the alarm was resolved. However, with the present disclosure, as the electric conductor 52 is secured to the rails or other fixed element by intermediary mounting brackets 64 at spaced intervals 76, as shown in FIG. 3, the electrical conductor 52 substantially moves in concert with the rails 26 and 28. Accordingly, even if the building does experience such significant sway, assuming the movable elements remain slidably mounted to the respective rail, the sensing head 72 will not contact the electrical conductor 52 and thus a false trip will not be generated.

Importantly though, if the movable element such as the counterweight 32 does in fact become derailed from its respective rail due to high winds the building may be experiencing, an earthquake, or the like, even with the electric conductor 52 moving in concert with the rails, the counterweight or any other movable element will move away from the rail a distance sufficient to cause the sensing head 72 to come into contact with electrical conductor 52, thereby closing the circuit and generating a derailment signal as desired, such as by a ground fault sensor 78 or the like.

Figure 7:
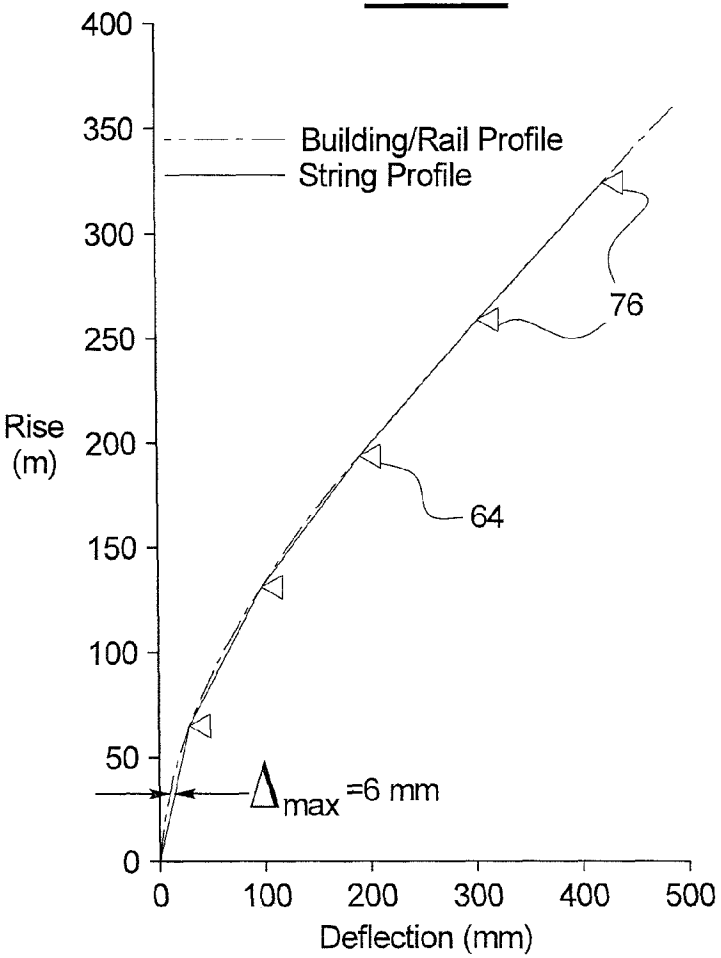
FIG. 7 is graph similar to FIG. 6 but showing the reduction in deflection achieved by the present disclosure.
Figure 6:
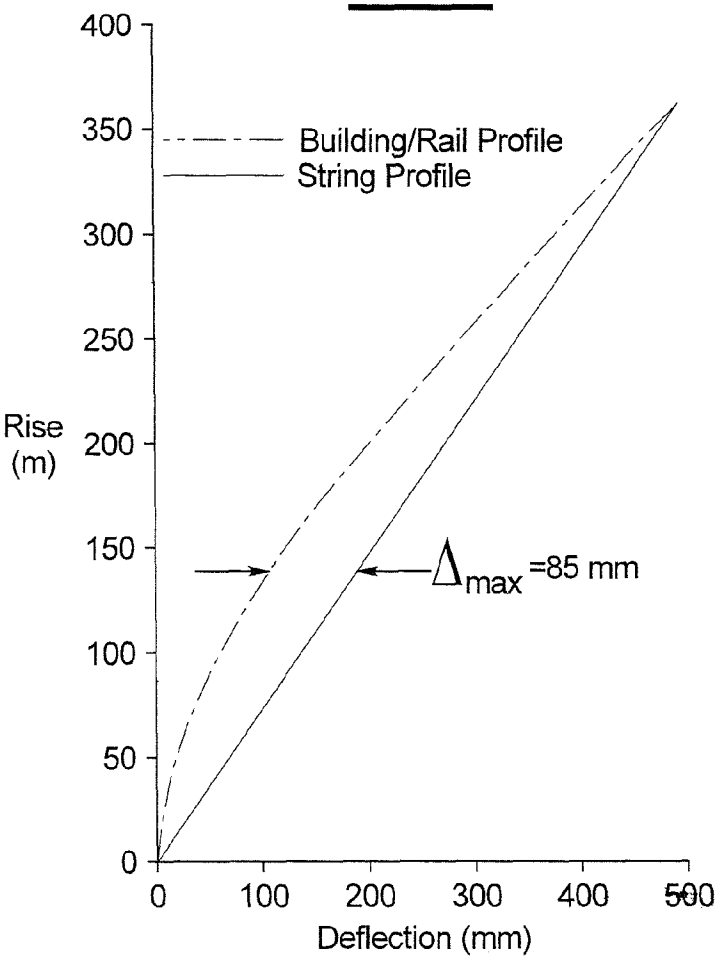
FIG. 6 is graph depicting a typical degree of deflection in a building due to sway.

While not a steadfast relationship, the inventors have found that by providing the spaced intervals 76 at approximately 200 feet (60.96 meters) apart, the electric conductor 52 will move substantially in concert with the rail 26 and 28 as the building sways under normal conditions. In other embodiments, the spaced intervals can of course be at other distances. The graphs provided in FIGS. 6 and 7 depict the improvement in this regard afforded by the present disclosure. Starting with FIG. 6, in a building 24 having an overall height of approximately 370 meters (1214 feet), without the teachings of the present disclosure, the electric conductor 52 may potentially be displaced from the rail to which it is associated by as much as 85 mm (0.28 feet) as the building sways. Under normal conditions, the spaced relationship between the sensing head 72 and electric conductor is on the order of a few millimeters. A displacement of 85 mm (0.28 feet) will certainly generate false trips of the elevator derailment detection system 51. By providing intermediary mounting brackets 64 at spaced intervals 76 along the hoistway 22, movement of the electrical conductor more closely tracks that of the rails to which it is attached, and the deflection between the electrical conductor 52 and the rails 26, 28 under normal building sway conditions can be substantially reduced to as little as 6 mm (0.019 feet) or less, as shown graphically in FIG. 7.

Figure 5:
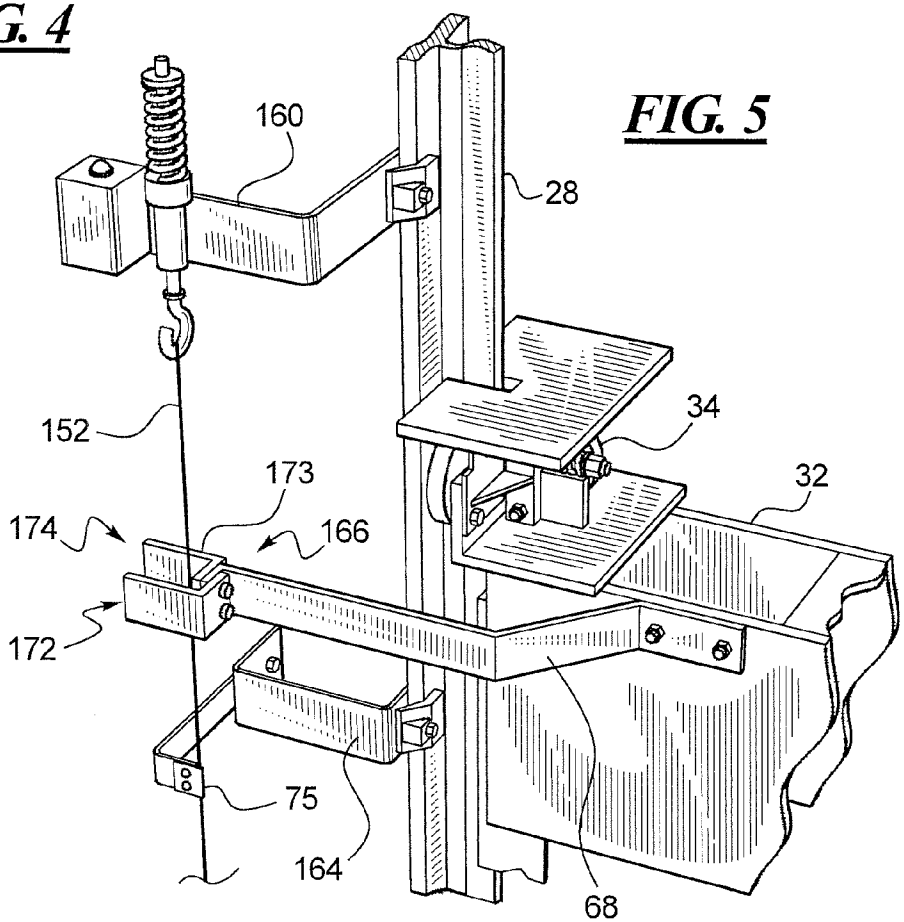
FIG. 5 is an enlarged view of section 4 of FIG. 4.
Figure 4:
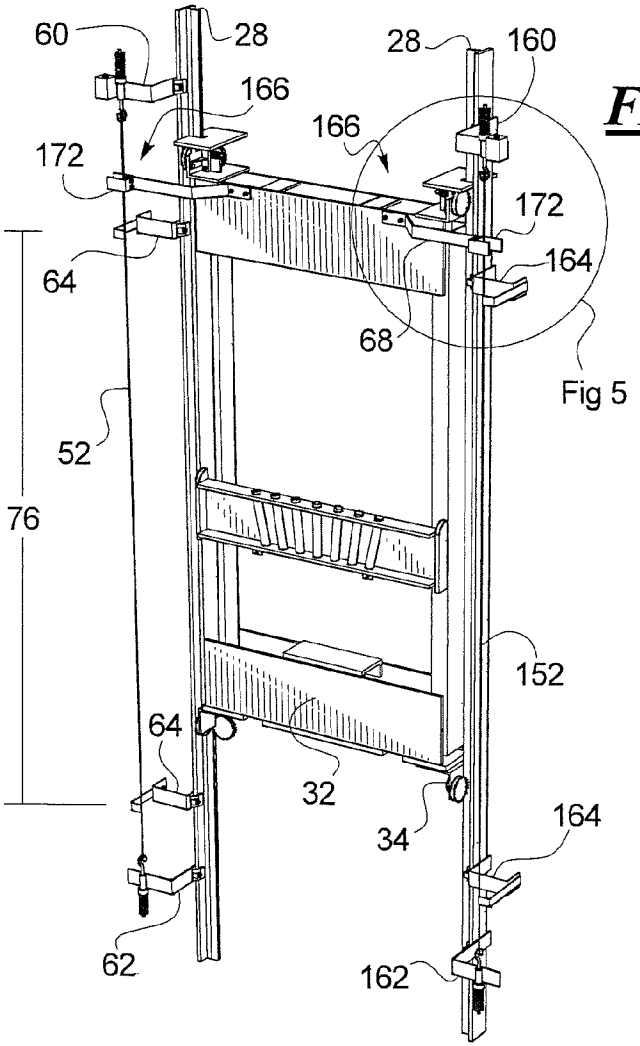
FIG. 4 is an isometric view of a second embodiment of the present disclosure.

Turning now to FIGS. 4 and 5, a second embodiment of the present disclosure is depicted. The second embodiment is in many ways identical to the first embodiment, but rather than including only one electrical conductor 52, a second electrical conductor 152 is provided. This electric conductor 152 also extends along the length of hoistway 22 and would be connected to the rails 26 or 28 or another fixed element within the hoistway 22 at spaced intervals 76 by way of a second set of intermediary mounting brackets 164. This form of redundant system not only serves as a secondary means of sensing derailments, but also allows for sensors 166 to include sensing heads 172 in the form of a U-shape, C-shape, or other less confining shape than the G-shape of the first embodiment. For example, as shown in FIG. 5, if one U-shaped sensing head 172 is provided with a non-continuous perimeter 173 having an open end 174 in a first direction, the other sensing head 172 could be provided with an open end 174 provided in a second, opposite direction. The combination of the two oppositely disposed sensors substantially provides for sway protection around a 360 degree range of motion of the building 24.

Based on the foregoing, it can be seen that the present disclosure provides for a mechanism by which derailment of a movable element within elevator system, such as a counterweight or an elevator car, can be accurately detected with minimal false trips even when the building is of significant height and is experiencing significant sway or other movement due to high winds, earthquakes, or other causes.

What is claimed is:

1. An elevator derailment detection system, comprising:

a movable element slidably mounted on a rail;

an electrical conductor extending through and connecting to a fixed element within a hoistway, the electrical conductor being held at electric potential;

a sensor connected to the movable element and including a sensing head having a non-continuous perimeter partially surrounding and in spaced relation to the electrical conductor; and a ground fault sensor configured to generate a derailment signal if the sensing head contacts the electrical conductor.

2. The elevator derailment detection system of claim 1, wherein a plurality of mounting brackets connect the electrical conductor to the fixed element within the hoistway.

3. The elevator derailments detection system of claim 1, wherein the movable element is a counterweight.

4. The elevator derailment detection system of claim 1, wherein the movable element is an elevator car.

5. The elevator hoistway derailment detection system of claim 1, wherein the fixed element is the rail.

6. The elevator derailment detection system of claim 1, where the electrical conductor extends vertically from a top to a bottom of the hoistway.

7. The elevator derailment detection system of claim 2, wherein the mounting brackets include at least one intermediate mounting bracket disposed at spaced intervals from a top mounting bracket and a bottom mounting bracket, to which the top and bottom ends of the electrical conductor are respectively fixed.

8. The elevator derailment detection system of claim 7, wherein the at least one intermediate mounting bracket comprises a plurality of intermediary mounting brackets disposed at spaced intervals along the hoistway.

9. The elevator derailment detection system of claim 1, wherein the sensing head is U-shaped.

10. The elevator derailment detection system of claim 1, wherein the sensing head with the non-continuous perimeter includes a least three sides.

11. The elevator derailment detection system of claim 1, wherein the sensing head is G-shaped.

12. The elevator derailment detection system of claim 1, further including a second rail and a second electrical conductor extending through the hoistway and held at electrical potential, a second set of mounting brackets connecting the second electrical conductor to a fixed element in electrical isolation, a second sensor connected to the movable element and including a second sensing head having a non-continuous perimeter partially surrounding the second electrical conductor.

13. The elevator derailment detection system of claim 12, wherein the second set of mounting brackets includes at least one intermediate mounting bracket.

14. A method of reducing false trips on an elevator derailment detection system, comprising:

extending an electrical conductor through an elevator hoistway provided in a building;

holding the electrical conductor at electric potential;

connecting the electrical conductor to a fixed element within the hoistway such that the electrical conductor moves substantially in concert with the hoistway as the building sways;

mounting a sensor to a movable element slidably mounted within the hoistway, the sensor including a sensing head at least partially surrounding and in spaced relation to the electrical conductor;

positioning the sensing head to make contact with the electrical conductor when the movable element derails from the rail; and providing a ground fault sensor associated with the movable element to identify when the electrical potential in the electric conductor is released into the movable element.

15. The elevator derailment detection system of claim 12, wherein the first and second sensing heads are U-shaped.

16. The method of claim 14, further including extending a second electrical conductor through the hoistway, connecting the second electrical conductor to a second fixed element extending through the hoistway, and mounting a second sensor to the movable element, the second sensor including a sensing head having a non-continuous perimeter partially surrounding the second electrical conductor.

17. The method of claim 14, wherein the step of connecting the electrical conductor to a fixed element within the hoistway includes attaching the electrical conductor to a top, bottom and at least one intermediary mounting bracket.

18. The method of claim 17, wherein the at least one intermediary mounting bracket comprises a plurality of intermediate mounting brackets that are installed at predetermined spaced intervals relative to the length of the electrical conductor.

19. An elevator derailment detection system, comprising;

a hoistway;

a rail extending within the hoistway;

a counterweight slidably mounted on the rail;

an electrical conductor extending vertically through the hoistway and held at electrical potential;

a plurality of mounting brackets connecting the electrical conductor to the rail; and a sensor connected to the counterweight and including a sensing head having a non-continuous perimeter substantially surrounding and in spaced relation to the electrical conductor; and a ground fault sensor configured to generate a derailment signal if the sensing head contacts the electrical conductor.

20. The elevator derailment detection system of claim 19, wherein the mounting brackets include a top mounting bracket, a bottom mounting bracket, and a plurality of intermediary mounting brackets.

21. The elevator derailment detection system of claim 20, wherein the intermediary mounting brackets are installed at spaced intervals along the electrical conductor.

22. The elevator derailment detection system of claim 19, further including a second rail and a second electrical conductor extending through the hoistway and held at electrical potential, a second set of mounting brackets connecting the second electrical conductor to a fixed element in electrical isolation, a second sensor connected to the movable element and including a second sensing head having a non-continuous perimeter partially surrounding the second electrical conductor.

* * * * *